United States Patent [19]

Watanabe

[11] Patent Number: 4,473,831

[45] Date of Patent: Sep. 25, 1984

[54] HEAT SENSITIVE RECORDING PAPER

[75] Inventor: Shojiro Watanabe, Shizuoka, Japan

[73] Assignee: Fuji Photo Film Co., Ltd., Kanagawa, Japan

[21] Appl. No.: 428,511

[22] Filed: Sep. 29, 1982

[30] Foreign Application Priority Data

Oct. 1, 1981 [JP] Japan ..... 56-156830

[51] Int. Cl.[3] ..... B41M 5/18

[52] U.S. Cl. ..... 346/209; 346/200; 346/214

[58] Field of Search ..... 282/27.5; 427/150, 151; 428/320.8, 411, 488, 537, 913, 914

[56] References Cited

FOREIGN PATENT DOCUMENTS 55-9827 1/1980 Japan ..... 346/209

*Primary Examiner*—Bruce H. Hess

*Attorney, Agent, or Firm*—Sughrue, Mion, Zinn, Macpeak and Seas

[57] ABSTRACT

A heat-sensitive recording paper is disclosed. The paper is comprised of a support base, a nearly colorless electron donating dye contained in a dispersion on the base, an organic acid capable of producing a color upon contact with the dye, the organic acid contained in a dispersion on the base, and a phenol compound contained in a dispersion on the base, the phenol compound being represented by the general formula (I) defined within the application. By including the particularly disclosed phenol compound within the heat-sensitive recording paper it is possible to obtain a color image which does not fade when stored even in adverse conditions. Furthermore, the inclusion of the phenol compound does not increase fogging.

5 Claims, No Drawings

HEAT SENSITIVE RECORDING PAPER

FIELD OF THE INVENTION

The present invention relates to heat-sensitive recording paper and particularly to heat-sensitive recording paper in which fading of recorded images is prevented.

BACKGROUND OF THE INVENTION

Heat-sensitive recording paper is that which forms images by utilizing a physical or chemical change of materials due to heat energy. A large number of processes involving both types of changes have been disclosed. For example, U.S. Pat. No. 3,131,080 discloses heat-sensitive recording paper which forms images by utilizing a physical change of material, and U.S. Pat. Nos. 2,663,654, 2,663,655 and 2,967,785 disclose such the paper which forms images by utilizing a chemical change of materials.

Recently, heat-sensitive recording paper has been used as recording paper for the output of facsimiles or of computers, because the paper has characteristics that the images are formed by primary coloring and a development step is not required. Such a heat-sensitive recording paper is called dye type. An example of this paper has been disclosed in Japanese Patent Publication Nos. 4160/68 and 14039/70 and Japanese Patent Application (OPI) No. 27253/80 (corresponding to U.S. Pat. No. 4,283,458) (the term "OPI" as used herein refers to a "published unexamined Japanese patent application", and hereinafter it refers the same).

When using heat-sensitive recording paper for recording, it is advantageous because the recording apparatus can be made light weight and small. Accordingly, it has been used frequently in recent years. On the other hand, heat-sensitive recording paper is not desirable because recorded images fade under the influence of external conditions such as humidity or heat. In some instances, the fading of the recording images is fatal fault to the practical application of the recording paper. Accordingly, there have been various proposals to improve this fault.

Japanese Patent Publication No. 43386/76 (corresponding to U.S. Pat. No. 3,937,864) discloses the addition of phenol derivatives such as 4,4'-thio-bis(6-tertbutyl-3-methyl-phenol), Japanese Patent Application (OPI) No. 17347/78 discloses the addition of water-insoluble modified phenol resin such as rosin modified phenol resin. Japanese Patent Application (OPI) No. 72996/81 discloses the addition of terephthalic acid esters such as diethyl terephthalate. However, all of these methods create undesirable coloring, so-called "fogging". The fogging is caused during production or preservation of the recording paper, though these methods do have an effect on preventing fading. The fogging is substantially increased under the influence of humidity and heat. Accordingly, the commercial value of such paper deteriorates remarkably under such conditions.

SUMMARY OF THE INVENTION

The object of the present invention is to provide the heat-sensitive recording paper which does not fog, and which produces recording images which are less susceptible to fading.

The above described object of the present invention has been attained by providing heat-sensitive recording paper which comprises a support base, a nearly colorless electron donating dye, an organic acid capable of coloring by contacting with said dye and a phenol compound represented by the following general formula (I):

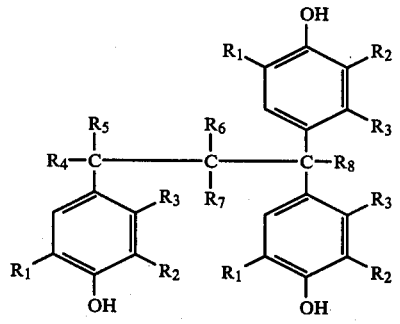

(I)

wherein $R_1$ represents a branched alkyl group having 3 to 8 carbon atoms, $R_2$ represents a hydrogen or a branched alkyl group having 3 to 8 carbon atoms, $R_3$ represents a hydrogen or an alkyl group having 1 to 3 carbon atoms, $R_4$ represents a hydrogen or an alkyl group having 1 to 8 carbon atoms, $R_5$, $R_6$ and $R_7$ each represents a hydrogen or an alkyl group having 1 to 3 carbon atoms, and $R_8$ represents a hydrogen or an alkyl group having 1 to 8 carbon atoms.

DETAILED DESCRIPTION OF THE INVENTION

Typical examples of phenol compounds represented by the general formula (I) used in the present invention include 1,1,3-tris(2-methyl-4-hydroxy-5-tert-butylphenyl)butane, 1,1,3-tris(2-ethyl-4-hydroxy-5-tert-butylphenyl)butane, 1,1,3-tris(3,5-di-tert-butyl-4-hydroxyphenyl)butane and 1,1,3-tris(2-methyl-4-hydroxy-5-tert-butylphenyl)propane.

These phenol compounds represented by the general formula (I) are used in an amount of 5 to 200% by weight and preferably 20 to 100% by weight based on the weight of the organic acid.

The electron donating dye used in the present invention is not restricted. Any dyes can be used provided it can be used for conventional pressure-sensitive recording paper or heat-sensitive recording paper. Examples of such dyes include (1) triarylmethane compounds, for example, 3,3-bis(p-dimethylaminophenyl)-6-dimethylaminophthalide (Crystal Violet lactone), 3-(p-dimethylaminophenyl)-3-(1,2-dimethylindol-3-yl)phthalide, 3-(p-dimethylaminophenyl)-3-(2-phenylindol-3-yl)-phthalide, 3,3-bis(9-ethylcarbazol-3-yl)-5-dimethylaminophthallide and 3,3-bis(2-phenylindol-3-yl)-5-dimethylaminophthalide; (2) diphenylmethane compounds, for example, 4,4'-bisdimethylaminobenzhydrin benzyl ether, N-halophenyl leuco Auramine and N-2,4,5-trichlorophenyl leuco Auramine; (3) xanthene compounds, for example, Rhodamine B-anilinolactam, 3-diethylamino-7-dibenzylaminofluoran, 3-diethylamino-7-octylaminofluoran, 3-diethylamino-7-(2-chloroanilino)fluoran, 3-diethylamino-6-methyl-7-anilinofluoran, 3-diethylamino-6-chloro-7-(β-ethoxyethyl)aminofluoran, 3-piperidino-6-methyl-7-anilinofluoran, 3-ethyl-tolylamino-6-methyl-7-anilinofluoran, 3-cyclohexylmethylanilino-6-methyl-7-anilinofluoran, 3-diethylamino-6-chloro-7-β-ethoxyethylaminofluoran and 3-diethylamino-6-chloro-7-γ-chloropropylaminofluoran; (4) thiazine compounds, for example, benzoyl leuco Methylene Blue and p-nitrobenzoyl leuco Methylene Blue; (5) spiro compounds, for example, 3-methyl-spiro-dinaphthopyran, 3-ethyl-spiro-dinaphthopyran, 3-benzyl-spiro-dinaphthopyran and 3-methylnaphtho(3-methoxybenzo)spiro-pyran; and mixtures of them. Particular dyes and combinations of dyes are used depending on the characteristics of the dyes and the results desired.

These electron donating dyes are used in an amount of 10 to 60% by weight based on the weight of the organic acid.

Preferred examples of organic acids used in the present invention include phenol derivatives and aromatic carboxylic acid derivatives. Bisphenols are particularly preferred. Examples of phenol derivatives include p-octylphenol, p-tert-butylphenol, p-phenylphenol, 1,1-bis(p-hydroxyphenyl)propane, 2,2-bis(p-hydroxyphenyl)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethyl-hexane and 2,2-bis(4-hydroxy-3,5-dichlorophenyl)propane.

Examples of aromatic carboxylic acid derivatives include p-hydroxybenzoic acid, ethyl p-hydroxybenzoate, butyl p-hydroxybenzoate, benzyl p-hydroxybenzoate, 3,5-di-tert-butylsalicylic acid, 3,5-di-α-methylbenzylsalicylic acid and polyvalent metal salts of the above described carboxylic acids.

When producing a coating solution for heat-sensitive recording paper, it is necessary to disperse the above described raw materials for the heat-sensitive recording paper in a dispersion medium such as water. It is preferable to add water-soluble high polymers such as polyvinyl alcohol, hydroxyethyl cellulose or starth derivatives in the dispersion medium. Among these water-soluble polymers, polyvinyl alcohol is preferable because of its high protective colloid property and low viscosity. The raw materials for the heat-sensitive recording paper are added to the dispersion medium containing 1% by weight to 10% by weight, preferably 2% by weight to 5% by weight, of the water-soluble high polymer. The dispersion of the raw materials is preferably prepared by adding and dispersing each component of the raw materials (i.e., the electron donating dye, the organic acid and the phenol compound represented by the general formula (I) to a respective dispersion medium in an amount of 10% by weight to 50% by weight based on the weight of the dispersion medium, respectively, and then mixing the thus prepared each dispersion. The raw materials are dispersed by means of a dispersing apparatus such as ball mill, sand mill, attriter or colloid mill.

To a mixture of the above described dispersion, if necessary, oil-absorbing pigments, waxes or metal soaps, etc., are added. The resulting coating solution for the heat-sensitive recording paper is applied to a base such as paper or plastics to obtain the desired heat-sensitive recording paper.

Examples of the oil-absorbing pigments include kaolin, calcined kaolin, talc, agalmatolite, diatom earth, calcium carbonate, aluminium hydroxide, magnesium hydroxide, magnesium carbonate, titanium oxide, barium carbonate, urea-formalin filler and cellulose filler.

Examples of the waxes include not only paraffin wax, carnauba wax, microcrystalline wax and polyethylene wax but also higher aliphatic acid amides such as stearic acid amide or ethylenebisstearoamide, and higher aliphatic acid esters.

Examples of the metal soaps include polyvalent metal salts of higher aliphatic acids such as zinc stearate, aluminium stearate, calcium stearate or zinc oleate.

In the following, an example is described, but the present invention is not limited to it.

EXAMPLE 20 g of 3-diethylamino-6-chloro-7-(β-ethoxyethyl-)aminofluoran was dispersed in 100 g of a 10% aqueous solution of polyvinyl alcohol (saponification value: 98%, degree of polymerization: 500) by mixing in a 300 ml ball mill for about 24 hours to obtain a dispersion (A). Likewise, 10 g of 2,2-bis(4-hydroxyphenyl)propane and 10 g of stearic acid amide were dispersed in 100 g of a 10% aqueous solution of polyvinyl alcohol by mixing in a 300 ml ball mill for about 24 hours to obtain a dispersion (B). Likewise, 20 g of 1,1,3-tris(2-methyl-4-hydroxy-5-tert-butylphenyl)butane was dispersed in 100 g of a 10% aqueous solution of polyvinyl alcohol by mixing in a 300 ml ball mill for about 24 hours to obtain a dispersion (C).

The dispersion (A), the dispersion (B) and the dispersion (C) were blended in a ratio by weight of 3:20:5. Further, 50 g of a finely divided powder of calcium carbonate was added to 200 g of the resulting mixture and sufficiently dispersed therein to obtain a coating solution.

The resulting coating solution for the heat-sensitive recording paper was applied to a base paper having an areal weight of 50 g/m$^2$ by an air knife so as to result in a coating amount of 6 g/m$^2$ of solid content. The coating was dried at 50° C. for 2 minutes to obtain heat-sensitive recording paper.

COMPARATIVE EXAMPLE 1

The dispersion (A) and the dispersion (B) in the Example were blended in a ratio by weight of 3:20. 50 g of a finely divided powder of calcium carbonate was added to 200 g of the mixture and sufficiently dispersed therein to obtain a coating solution, which was applied by the same manner as in the Example to obtain heat-sensitive recording paper.

COMPARATIVE EXAMPLE 2

Heat-sensitive recording paper was obtained by the same procedure as in the Example, except that the dispersion (C) was obtained with 20 g of 4,4'-thio-bis-(6-tert-butyl-3-methylphenol) instead of 20 g of 1,1,3-tris(2-methyl-4-hydroxy-5-tert-butylphenyl)butane which was used in the Example.

COMPARATIVE EXAMPLE 3

Heat-sensitive recording paper was obtained by the same procedure as in the Example, except that the dispersion (C) was obtained with 20 g of diethyl terephthalate instead of 20 g of 1,1,3-tris(2-methyl-4-hydroxy-5-tert-butylphenyl)butane.

Comparison Test

Comparison tests of the heat-sensitive recording papers obtained in the Example and Comparative Examples were carried out as follows.

(1) Fog and Developability

Recording was carried out by applying an energy of 2 ms/dot and 50 mJ/mm$^2$ at a density of main scanning 5 dots/mm and sub-scanning 6 dots/mm to recording elements. Fog (density of the ground before recording) and density of the developed color after recording (initial density) were measured by a Macbeth RD-514 reflective densitometer (using a visual filter).

(2) Moisture Resistance

After carrying out the developability test the developed materials were allowed to stand for 24 hours in an atmosphere of 50° C. and RH 90%. Thereafter, the fog (density of the ground) and density of the developed color were measured.

Further, the residual ratio of developed color was calculated by the following formula.

$$\frac{\text{Density after allowed to stand}}{\text{Initial density}} \times 100\ (\%) = \text{residual ratio}$$

(3) Heat Resistance

After carrying out the developability test the developed materials were allowed to stand for 24 hours in an atmosphere of 60° C. and RH 20%. Thereafter, fog (density of the ground) and density of the developed color were measured. Further, the residual ratio of developed color was calculated by the following formula.

$$\frac{\text{Density after allowed to stand}}{\text{Initial density}} \times 100\ (\%) = \text{residual ratio}$$

Results of the comparison tests are shown in Table 1.

TABLE 1

| | Initial | | Moisture Resistance | | | Heat Resistance | | |
|---|---|---|---|---|---|---|---|---|
| | Fog | Density | Fog | Density | Residual Ratio (%) | Fog | Density | Residual Ratio (%) |
| Example | 0.07 | 0.93 | 0.10 | 0.88 | 95 | 0.08 | 0.90 | 97 |
| Comparative Example 1 | 0.07 | 0.90 | 0.10 | 0.40 | 44 | 0.08 | 0.45 | 50 |
| Comparative Example 2 | 0.13 | 0.93 | 0.30 | 0.87 | 94 | 0.35 | 0.90 | 97 |
| Comparative Example 3 | 0.20 | 0.92 | 0.25 | 0.68 | 74 | 0.22 | 0.72 | 78 |

The results as shown in Table 1 clearly indicate that the inclusion of a compound encompassed by general formula (I) in a dispersion used in making a heat-sensitive paper gives improved results. More specifically, the use of such a compound results in good density of an image formed with the paper and the density remains good even when stored under adverse conditions. Furthermore, the improved density after storage is not accompanied by increased fog.

In Comparative Example 2, both residual ratios after storage under high humidity and high temperature are high, however, both fog densities are increased.

It is understood from the above described Table that the heat-sensitive recording paper of the present invention causes a less degree of fading by humidity and heat as compared with the comparative heat-sensitive recording papers, and they are excellent in fogging, too.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper, comprising:

a support base;

a nearly colorless electron donating dye contained in a dispersion on the base, wherein the electron donating dye is present in an amount of 10–60 percent by weight based on the weight of an organic acid hereinafter described;

an organic acid capable of producing a color upon contact with the dye, the organic acid contained in a dispersion on the base; and a phenol compound contained in a dispersion on the base and present in an amount of 5–200 percent by weight based on the weight of the organic acid, the phenol compound being represented by the general formula (I):

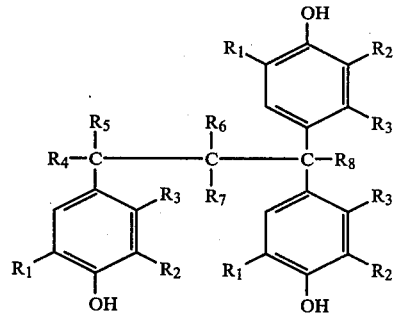

(I)

wherein $R_1$ represents a branched alkyl group having 3 to 8 carbon atoms, $R_2$ represents a hydrogen or a branched alkyl group having 3 to 8 carbon atoms, $R_3$ represents a hydrogen or an alkyl group having 1 to 3 carbon atoms, $R_4$ represents a hydrogen or an alkyl group having 1 to 8 carbon atoms, $R_5$, $R_6$ and $R_7$ each represents a hydrogen or an alkyl group having 1 to 3 carbon atoms, and $R_8$ represents a hydrogen or an alkyl group having 1 to 8 carbon atoms.

2. A heat-sensitive recording paper as claimed in claim 1, wherein the compound represented by the general formula (I) is a compound selected from the group consisting of 1,1,3-tris(2-methyl-4-hydroxy-5-tert-butylphenyl)butane, 1,1,3-tris(2-ethyl-4-hydroxy-5-tert-butylphenyl)butane, 1,1,3-tris(3,5-di-tert-butyl-4-hydroxyphenyl)butane and 1,1,3-tris(2-methyl-4-hydroxy-5-tert-butylphenyl)propane.

3. A heat-sensitive recording paper as claimed in claim 1 wherein the compound represented by the general formula (I) is present in an amount of 20 to 100% by weight based on the weight of the organic acid.

4. A heat-sensitive recording paper as claimed in any of claims 1 or 2, wherein the dye, organic acid, and phenol compound are contained within an aqueous dispersion containing a water-soluble high polymer.

5. A heat-sensitive recording paper as claimed in claim 4, wherein the water-soluble high polymer is a compound selected from the group consisting of polyvinyl alcohol, hydroxyethyl cellulose and starch derivatives.

* * * * *